United States Patent [19]

Tihansky

[11] Patent Number: 4,930,827

[45] Date of Patent: Jun. 5, 1990

[54] HOISTING HOOKS USED TO LIFT, TRANSPORT AND DUMP METALLURGICAL LADLES

[75] Inventor: Eugene L. Tihansky, Bethlehem, Pa.

[73] Assignee: Bethlehem Steel Corporation, Bethlehem, Pa.

[21] Appl. No.: 827,039

[22] Filed: Feb. 7, 1986

[51] Int. Cl.[5] ..... B66C 1/28

[52] U.S. Cl. ..... 294/81.56; 294/68.27; 294/67.3

[58] Field of Search ..... 294/67.3, 68.26, 68.27, 294/68.2, 68.1, 67.31, 82.1, 82.12, 81.56, 68.3

[56] References Cited

U.S. PATENT DOCUMENTS 2,048,277 7/1936 Mays ..... 294/82.1

FOREIGN PATENT DOCUMENTS 1537150 8/1968 France ..... 294/68.27

*Primary Examiner*—Margaret A. Focarino
*Assistant Examiner*—Dean J. Kramer
*Attorney, Agent, or Firm*—John I. Iverson

[57] ABSTRACT

The hoisting hook assembly of this invention comprises a pair of parallel hook arms connected at their upper end to a bail with the hook arms each having an upper hook portion and a lower hook portion adapted to engage a single pair of ladle trunnion pins. This assembly permits existing cranes to transport and invert large ladles.

1 Claim, 3 Drawing Sheets

HOISTING HOOKS USED TO LIFT, TRANSPORT AND DUMP METALLURGICAL LADLES

BACKGROUND OF THE INVENTION

This invention relates to metallurgical ladles commonly used to transfer, treat and pour molten metals, such as steel. It relates particularly to hoisting hooks used to lift and transfer molten metal from a furnace to ladle treatment position or a teeming position where the molten metal is poured into ingot molds or a continuous caster. The ladle is then lifted and moved to a pit where the ladle is inverted to dump residual slag and skull from the ladle into the pit.

Metallurgical ladles of the type used in the steel industry are large open top containers having a steel shell lined with refractory and a bottom pouring nozzle. A pair of trunnion pins are mounted on diametrically opposite sides of the steel shell to permit the ladle to be lifted easily in an upright position for transport and to be inverted 180° to dump the slag and skull.

Apparatus for tilting and dumping metallurgical ladles consisting of bottom linkage is described in U.S. Pat. Nos. 2,881,488 and 3,550,816.

In recent years, steelmakers have increased the size of the ladles in a shop either to provide sufficient freeboard height for ladle treatment operations, such as reagent injection, or to accommodate increased furnace capacity. In many shops the lifting height of the ladle cranes to accommodate the larger ladles cannot be increased easily due to structural limitations in the shop building. The crane lifting height in the shop must be sufficient not only to allow the ladle to clear all objects in the path of its transport to the ladle treatment or teeming stations, but also to permit the ladle to be inverted over the pit while being dumped.

SUMMARY OF THE INVENTION

It is therefore an object of this invention to provide a hoisting hook assembly which permit larger ladles to be used in a shop without increasing the crane lifting height.

It is a further object of this invention to provide a hoisting hook assembly which is able to lift and transport a ladle at two different elevations.

It is a further object of this invention to provide a hoisting hook assembly that will permit a larger ladle to be inverted 180° during dumping.

It is a still further object of this invention to provide a hoisting hook assembly easily adaptable to all ladles now being used.

It has been discovered that the foregoing objectives can be attained by a hoisting hook assembly comprising a pair of parallel hook arms connected at their upper end to a bail with the hook arms each having an upper hook portion and a lower hook portion adapted to engage the ladle trunnion pins.

DESCRIPTION OF THE PREFERRED EMBODIMENT OF THIS INVENTION

Figure 1:
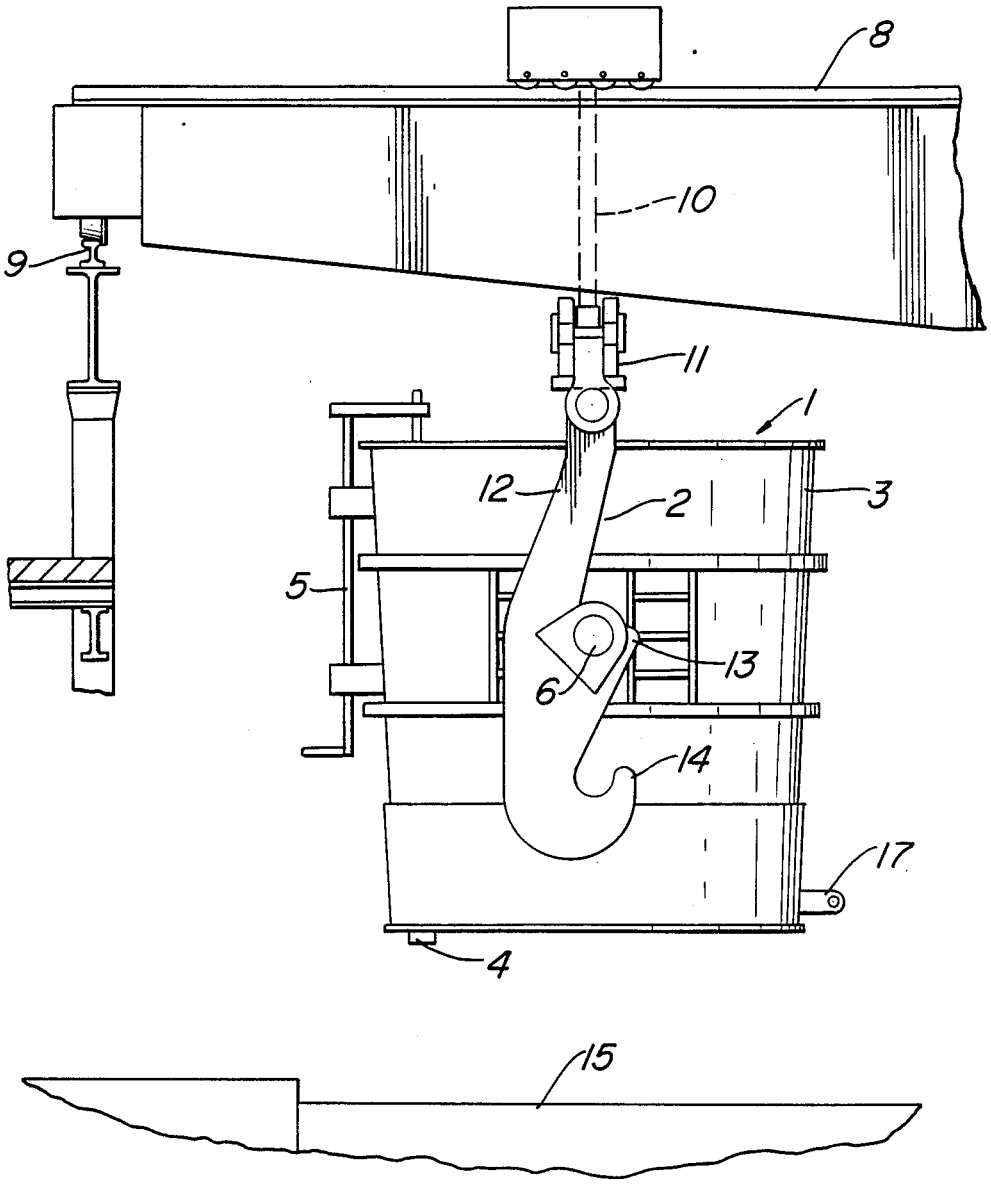
FIG. 1 is an elevation view showing the ladle in a position for transport and teeming.

FIG. 1 illustrates a metallurgical ladle 1 being hoisted by the hoisting hook assembly 2 of this invention in an upright position suitable for transporting the ladle or teeming the molten metal from the ladle.

Ladle 1 is comprised of a steel shell 3 lined with refractory and having a pouring nozzle 4 in the bottom controlled by a stopper rod assembly 5. The ladle 1 is provided with a pair of trunnion pins 6 and trunnion blocks 7 each positioned diametrically opposite to the other on opposite sides of the ladle 1. The trunnion pins 6 are positioned above the center of gravity of the ladle, whether full or empty, so that the top of the ladle will normally lie in a horizontal plane when it is lifted and transported by the crane hook assembly 2.

Figure 2:
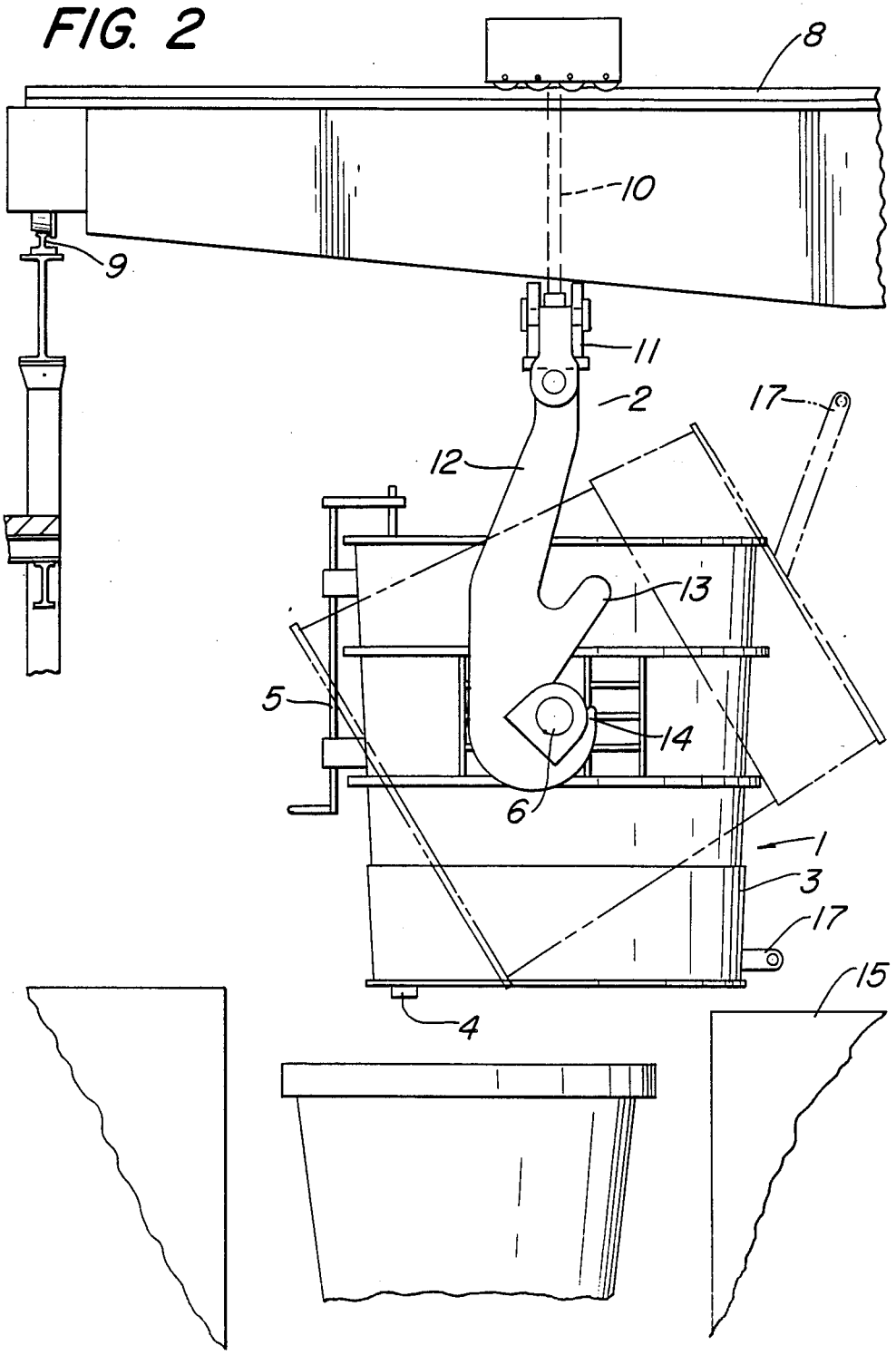
FIG. 2 is an elevation view showing the ladle being transported and also in an inverted position (phantom lines) for the dumping of slag and skull.
Figure 3:
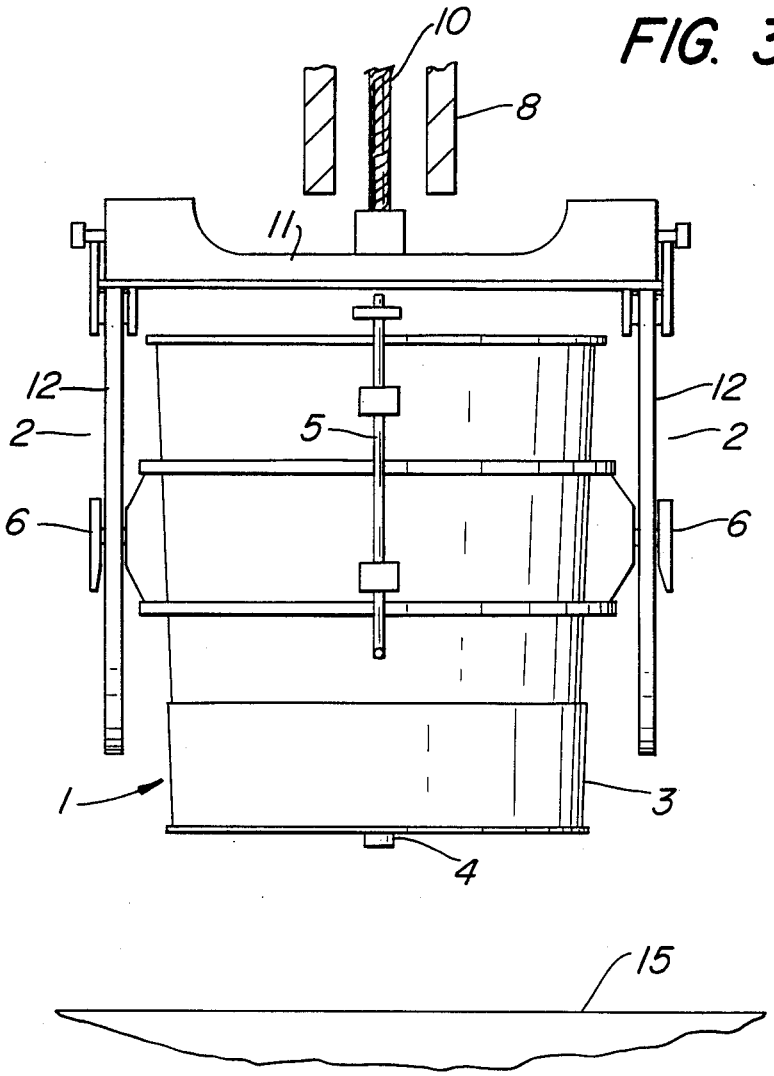
FIG. 3 is an end view of the ladle shown in FIG. 1.

A bridge type crane 8 traveling on elevated parallel rails 9, is used to transport the ladle from the furnace to a ladle treatment station or a teeming station in the shop. The crane 8 is provided with ropes 10 attached to a bail 11 to which are connected a pair of parallel hook arms 12 which hang suspended from the bail 11. The hook arms 12 are made of heavy forged steel and are shaped to form an arcuate upper hook portion 13 and a lower arcuate hook portion 14 which are adaptable to slide along and engage the trunnion pins 6 as shown in FIGS. 1 and 2.

The crane hook assembly 2 of this invention allows the crane operator to lift the ladle using the upper hook portion 13 to obtain maximum clearance between the bottom of the ladle 1 and the floor 15 when the ladle is used to transport or teeming the molten metal.

When the teaming operation is completed, the ladle 1 must be dumped of any remaining slag and skull before the ladle 1 can be used again. To dump the ladle where the floor 15 to bail 10–11 headroom is limited, the ladle 1 is set on the floor and the trunnion pins 6 released from the upper hook portions 11 of the hook arms 12. The crane operator then places the lower hook portions 14 of the hook arms 12 around the trunnion pins 6. When the ladle 1 is lifted with the hook assembly 2 in this position, there is now sufficient clearance between the bottom of the bail 10 and the bottom of the ladle 1 to permit the ladle 1 to be inverted 180° using a pivoted bottom link assembly 17 and an auxiliary hoist (not shown) as described in U. S. Pat. Nos. 2,881,488 or 3,550,816, and dump the slag and skull into a pit 18 slag container 19 as illustrated in FIG. 2.

The centerline of the upper hook portions 13 and the lower hook portions 14 of the hook arms 12 lie in a vertical plane. Their spacing on the hook arm 12 will vary according to the size of the ladle, the configuration of the shop and the height between the shop floor and the crane bail.

The crank hook assembly of this invention while simple in construction will eliminate the need to lower the shop floor or to raise the elevation of the crane rails 9 both of which are very expensive, in shops when they are modernized with larger ladles.

While the present invention has been described and illustrated with our preferred embodiment, it will be appreciated by those skilled in this art, after understanding this invention, that various changes and modifications may be made without departing from the spirit and scope of this invention. It is therefore intended that all such changes and modifications will be included in the following claims.

I claim:

1. A hoisting hook assembly for lifting a metallurgical ladle having a single pair of diametrically opposed trunnion pins, comprising a pair of parallel hook arms connected at their upper end to a bail, said hook arms each having an upper hook portion and a lower hook portion each in the shape of an arcuate recess extending inwardly from one edge of said hook arm and adapted to engage and disengage from said trunnion pins.

* * * * *